United States Patent [19]

Amato et al.

[11] 3,971,112

[45] July 27, 1976

[54] METHOD OF MAKING A COVERED ARTICLE

[75] Inventors: Frank M. Amato, Detroit; Richard E. England, Birmingham, both of Mich.

[73] Assignee: Ford Motor Company, Dearborn, Mich.

[22] Filed: Sept. 22, 1975

[21] Appl. No.: 615,640

[52] U.S. Cl. ..... 29/91.1; 29/407; 29/423; 29/460; 29/464; 156/93; 264/46.6; 5/345 R

[51] Int. Cl.[2] ..... B68G 7/00

[58] Field of Search ..... 29/460, 464, 91.1, 423, 29/407, 445; 264/46.6, 464; 156/78, 90, 93; 5/345 R

[56] References Cited

UNITED STATES PATENTS

| | | | |
|---|---|---|---|
| 2,838,100 | 6/1958 | Follows | 29/91.1 UX |
| 3,023,430 | 3/1962 | Seymour | 5/345 R |
| 3,187,069 | 6/1965 | Pincus et al. | 264/46.6 X |
| 3,258,511 | 6/1966 | McGregor | 264/46.4 |
| 3,270,393 | 9/1966 | Levenson | 29/91.1 |
| 3,302,276 | 2/1967 | Williams et al. | 29/407 |
| 3,374,517 | 3/1968 | Worley | 29/91.1 |
| 3,576,059 | 4/1971 | Pearson | 29/91.1 |
| 3,781,969 | 1/1974 | Anderson | 29/445 |
| 3,932,252 | 1/1976 | Woods | 264/46.6 X |

*Primary Examiner*—Charlie T. Moon
*Attorney, Agent, or Firm*—William E. Johnson; Keith L. Zerschling

[57] ABSTRACT

A method of making a covered article such as an automobile seat cushion is disclosed. The method includes the steps of forming covering members from a covering material which is impervious to a foam material formed by reacting a foamable composition. The covering members are sewed together along sew lines to form a cover. A peripheral edge of the cover is joined to an interior peripheral edge of a locating member. A plurality of small openings are formed along the sew lines of the cover in the sewing operation. These openings are sealed so that the foam material produced upon the foaming of the foamable composition cannot flow therethrough. The cover and attached locating member are positioned in a foaming mold. The locating member aligns the cover properly with respect to the foaming mold so that a vacuum can be drawn on a die surface of the mold to draw a surface of the cover into contact with the die surface. A charge of the foamable composition is placed in an interior volume of the cover and the foaming mold is closed. The foamable composition is reacted to fill the interior volume of the cover with the foam material. The foam mold is opened and the cover is removed therefrom. The locating member is removed from the cover.

9 Claims, 6 Drawing Figures

METHOD OF MAKING A COVERED ARTICLE

BACKGROUND OF THE INVENTION

Many processes have been taught in the prior art for forming a covered article such as an automobile seat cushion. For example it has been proposed to vacuum form an outside cover from a sheet of vinyl and then to react a foamable composition within the interior volume of the cover to form the resilient portion of the seat cushion. One difficulty encountered with such a vacuum forming method is that only a special vinyl material may be used in the process because of the depth of the draw on the material in the forming operation. The vinyl material used in the process is relatively expensive also because the material must be heat resistant. Thus a seat cushion made with a vacuum formed cover and a foamed interior has its drawbacks.

Another method for forming a covered article such as an automobile seat cushion is one wherein the cover of the article is formed in an injection molding operation. The mold and molding press for such a molding operation are very expensive. Also after a cover is injection molded, it has to be painted in order to obtain the proper color on the exterior surface thereof. Thus, forming a seat cushion by manufacturing the exterior cover in an injection molding operation and thereafter reacting a foamable composition therewith also has its drawbacks.

Still another method proposed for forming a covered article such as an automobile seat cushion is one wherein a self-skinning foam is employed. In this case, the foamable composition is reacted in a mold and it produces its own relatively thin exterior skin and a porous resilient interior. The difficulty with this process is that the weight per unit volume is higher than covered articles produced by other methods. Also the finished seat cushion is relatively hard and does not give the seating comfort desired. This type of construction also has to be painted in order to produce a finished article. Also, as another drawback to this process no cloth or vinyl material can be utilized as the foam develops its own exterior skin.

SUMMARY OF THE INVENTION

This invention is directed to a method of making a covered article, and more particularly to a method of making a covered article which may be used as a seating member.

In accordance with the broad concepts of the method of this invention, a covered article is fabricated in the following way. At least a pair of covering members are formed of a covering material. The covering material is impervious to a foam material which is formed from a foamable composition. The covering members are sewn together along at least one sew line to form a cover having a peripheral edge portion therearound and an interior volume. The sewing operation places openings through the cover which permit the passage of the foam material through the cover. These openings are along the sew lines of the cover.

A locating member is formed in a separate operation. The locating member has an inner peripheral edge portion therearound defining a central opening therein. The locating member also has locating portions between the inner peripheral edge portion and an outer peripheral edge portion. The locating member's inner peripheral edge has the same general configuration as the peripheral edge portion of the cover.

The peripheral edge portion of the cover is joined to the inner peripheral edge portion of the locating member. This joining may be accomplished in a sewing operation.

The openings along the sew lines joining the covering members together are sealed. These openings are sealed so that the foam material produced upon foaming of the foamable composition cannot flow through the openings and thus ruin the outer surface to the finished covered article.

The cover and joined locating member are placed in a foaming mold. The foaming mold has a mold portion containing a die surface upon which a vacuum can be drawn and an openable cover portion. The locating portions of the locating member are aligned with locating positions on the foaming mold to align accurately the cover with the die surface of the foaming mold. A vacuum is drawn on the die surface of the foaming mold thereby to draw a facing surface of the cover into contact with the die surface. This action forms an interior volume in the cover between the inner surface of the cover and the cover's peripheral edge. A charge of a foamable composition is placed into the interior volume of the cover. The cover portion of the foaming mold is closed. The foamable material is reacted to fill the interior volume of the cover with a foam material. After the foaming operation the foaming mold is opened.

After the foaming mold is opened, the cover, foam material and locating member are removed from the mold as a single unit. Thereafter, the locating member is removed from the cover thereby to form a covered article.

BRIEF DESCRIPTION OF THE DRAWINGS

Each of the figures of the drawings is a diagrammatical sketch representing one of various steps in the method of this invention for producing a covered article such as an automobile seat cushion.

DESCRIPTION OF THE PREFERRED EMBODIMENT

Figure 1:
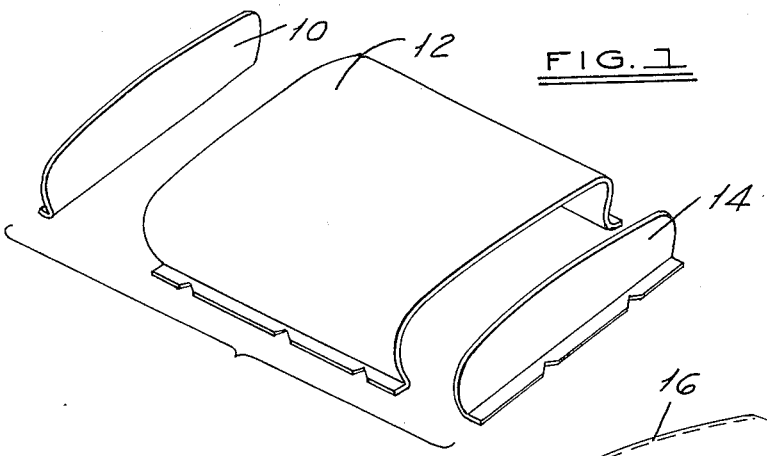
FIG. 1 illustrates the covering members to be sewn together to form a cover.

In FIG. 1 three covering members 10, 12 and 14 are shown. The members are formed from a covering material which is impervious to a foam material which is developed upon reaction of a foamable composition such as a polyurathane foam. The covering material may be, for example, an impervious vinyl sheet. The covering material may also be a cloth which has an impervious layer applied to the under surface thereof. The covering material may also be one or more plys of material, some of which plys are impervious so that the material as a whole is foamed impervious. The covering members 10, 12 and 14 are cut out of the covering material in a standard cutting operation.

The covering members 10, 12 and 14 are sewn together along their edges at sew lines 16 and 18 (FIG. 2) in order to form a cover, generally identified by the numeral 20. As is known in the art, the sewing operation is accomplished with the back surfaces of the covering members 10, 12 and 14 being exposed. Thus, as viewed in FIG. 2, the surface of the cover 20 shown is the one which will form the interior of the final article. In the process discussed herein, the article to be manufactured is an automobile seat cushion.

The sewing operation which produces the cover 20 also result in the cover having a peripheral edge portion 22 formed therearound. This peripheral edge portion has a plurality of locating apertures 24 therein for a purpose which will be described below. These apertures 24 may be formed in the members during the cutting operation described above.

In the sewing operation which produces the sew lines 16 and 18, a plurality of small openings are formed through the otherwise foam impervious covering material which forms the covering members. These openings are of sufficient size that when a foamable composition is foamed inside the interior of the cover, foam material will pass through such openings and either ruin the cover or, in the alternative, result in an additional operation for cleaning up the cover to make it acceptable for its intended use.

Figure 2:
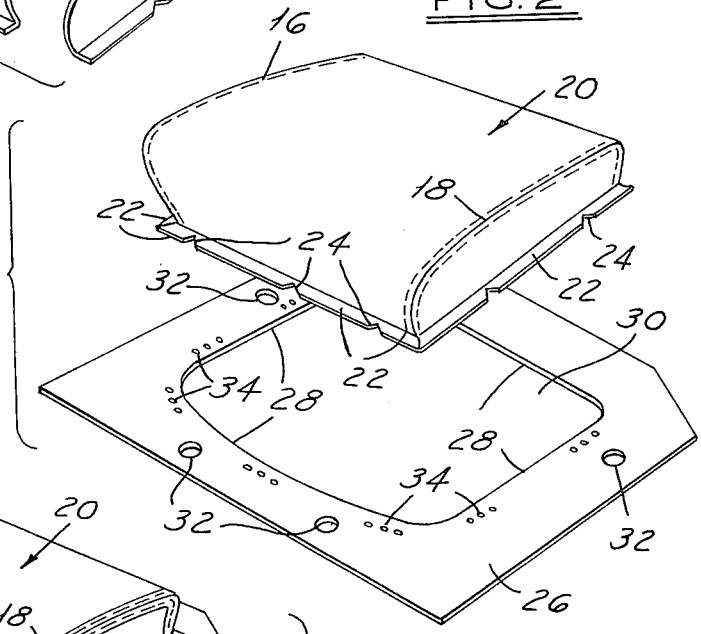
FIG. 2 illustrates the joining of a cover to a locating member.

With reference now to FIG. 2, a locating member 26 is shown. This locating member, which can be made of a material such as cardboard, has an inner peripheral edge portion 28 therearound defining a central opening 30. The inner peripheral edge portion 28 of the locating member 26 has the same general configuration as the peripheral edge portion 22 of the cover 20. Between the inner peripheral edge portion 28 of the locating member and its outer peripheral edge portion a plurality of locating openings 32 are provided. A plurality of alignment markings 34 are also provided between the inner and outer peripheral edge portions of the locating member.

Figure 3:
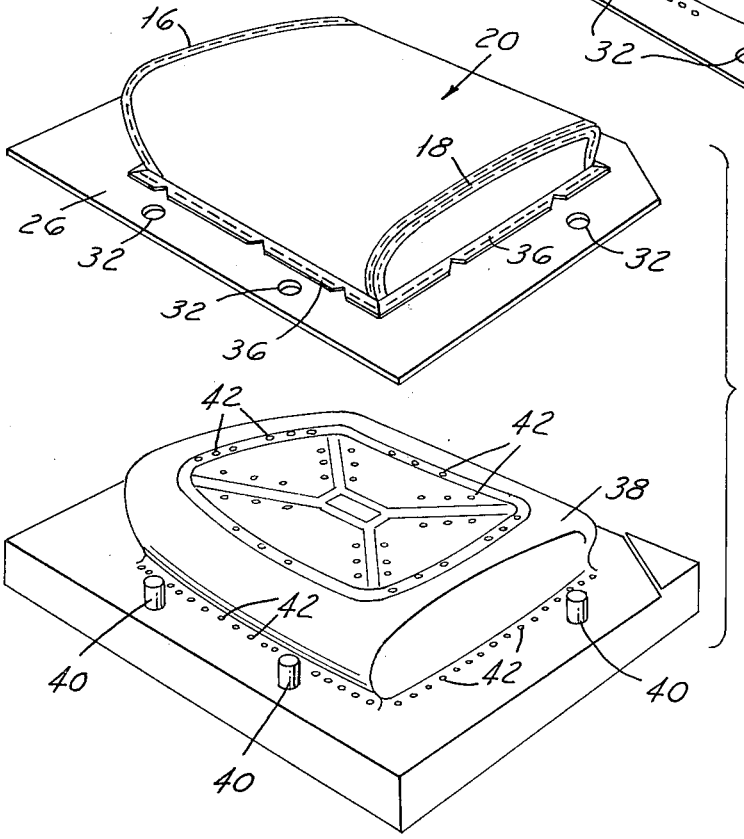
FIGS. 3 and 4 illustrate the sealing of openings which were formed when the covering members were sewn together to form a cover.

The peripheral edge portion 22 of the cover 20 is joined, as by a sewing operation, to the inner peripheral edge portion 28 of the locating member 26. In order to make sure that the cover is accurately aligned with the locating member, the locating apertures 24 of the cover are aligned with the alignment markings 34 of the locating member such that the center of the aperture is centered over the central one of the alignment markings. This action insures that the cover is properly located with respect to the locating member during the operation which joins these two. As stated above, in the preferred embodiment the operation which joins the cover to the locating member is a sewing operation. However, other operations such as stapling, tacking, dielectric or adhesively bonding the peripheral edge portion of the cover to the inner peripheral edge portion of the locating member are satisfactory. The only thing required of this operation is to produce a unit in which the cover 20 is joined to the locating member 26 along a plurality of joining lines 36 so that the two form a single unit. As shown in FIG. 3, these two elements are joined together with the interior surface of the cover exposed.

The assembled cover 20 and locating member 26 are placed on a seating buck 38 with the interior surface of the cover exposed. The seating buck defines generally the shape of the seat to be formed. A plurality of locating pins 40 on the seating buck are used in conjunction with the locating openings 32 of the locating member 26 to insure that the cover is placed in a proper position on the seating buck. The seating buck is also provided with a plurality of vacuum openings 42 through which a vacuum can be drawn on the interior of the cover which in this case is actually the surface of the cover which will form the exposed portion of the final article. When the cover is placed on the seating buck, the vacuum is drawn on the seating buck in order to pull the cover with its interior surface exposed into contact with the seating buck.

While the cover 20 is on the seating buck 38, the openings formed along sew lines 16 and 18 are sealed so that the foam developed upon the foaming of the foamable composition will not have an opportunity to flow therethrough. While FIG. 4 does not show the operation as being carried on the seating buck, it must be kept in mind that during this operation the cover member is located on the seating buck with the vacuum system operative so that the cover member is properly located with respect to the seating buck.

Figure 4:
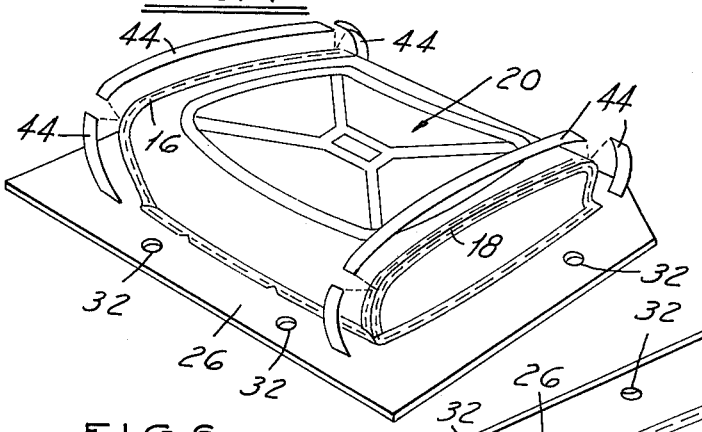

In accordance with the teachings of the preferred embodiment of this invention, the openings along the sew lines 16 and 18 of the cover 20 are sealed by application of a sealing tape 44, strips of which are shown in FIG. 4. Preferably, this tape is of the pressure sensitive type and is applied by unrolling the tape, cutting it to proper length and applying it over the sew lines 16 and 18. The sew lines are sealed on both sides thereof for a sufficient width that no foam may leak through the openings formed along the sew lines.

While the preferred way of accomplishing the sealing of the openings is one in which a pressure sensitive tape is used, many alternate ways of sealing these openings can be employed. For example, an adhesive may be applied across a width of the sew lines and then a foam impervious material may be laid over the adhesive to seal the openings. The openings may also be sealed by applying a liquid material which solidifies to form a sealant which is impervious to the passage of foam therethrough. It is also apparent that there are many alternate ways for accomplishing the sealing of these openings. The principal requirement for the operation is that it be one which can be carried out efficiently and that it be one which produces a seal for the opening that does not allow the foam material produced by reaction of the foaming composition to pass through any of the openings.

After the openings on sew lines 16 and 18 have been sealed and made impervious to the foam material, the cover 20 and its attached locating member 26 are removed from the seating buck 38. When the operator pulls up on the locating member to remove it and the cover from the seating buck, the cover 20 is turned inside out so that the surface of the material which will form the exposed portion of the final cover is now exposed. This conditions is shown in FIG. 5.

Figure 5:
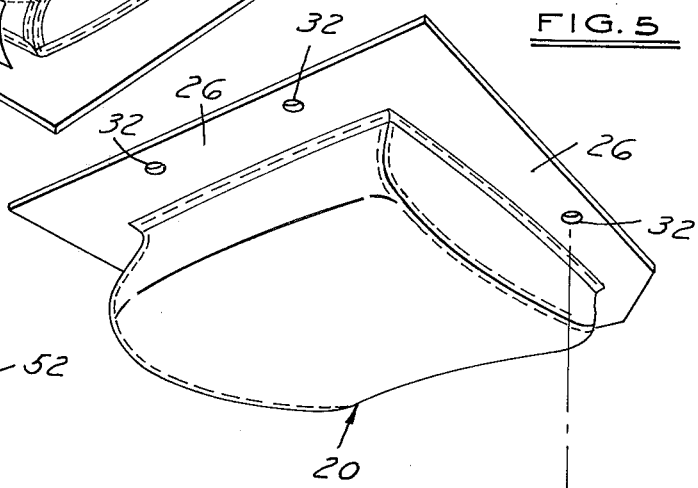
FIG. 5 represents the positioning of the cover member and the locating member in a foaming mold.

FIG. 5 illustrates the step of the process in which the cover 20 and its attached locating member 26 are positioned in a foaming mold generally identified by the numeral 46. The foaming mold has a mold portion 48 containing a die surface 50 having a plurality of fine vacuum openings (not shown) on which a vacuum may be pulled. The foaming mold also has a cover portion 52 which is generally closed during a forming operation. The mold portion 48 is also provided with locating pins 54 which are receivable in locating openings 32 of the locating member 26 to insure that the cover 20 is properly aligned with the die surface 50.

Figure 6:
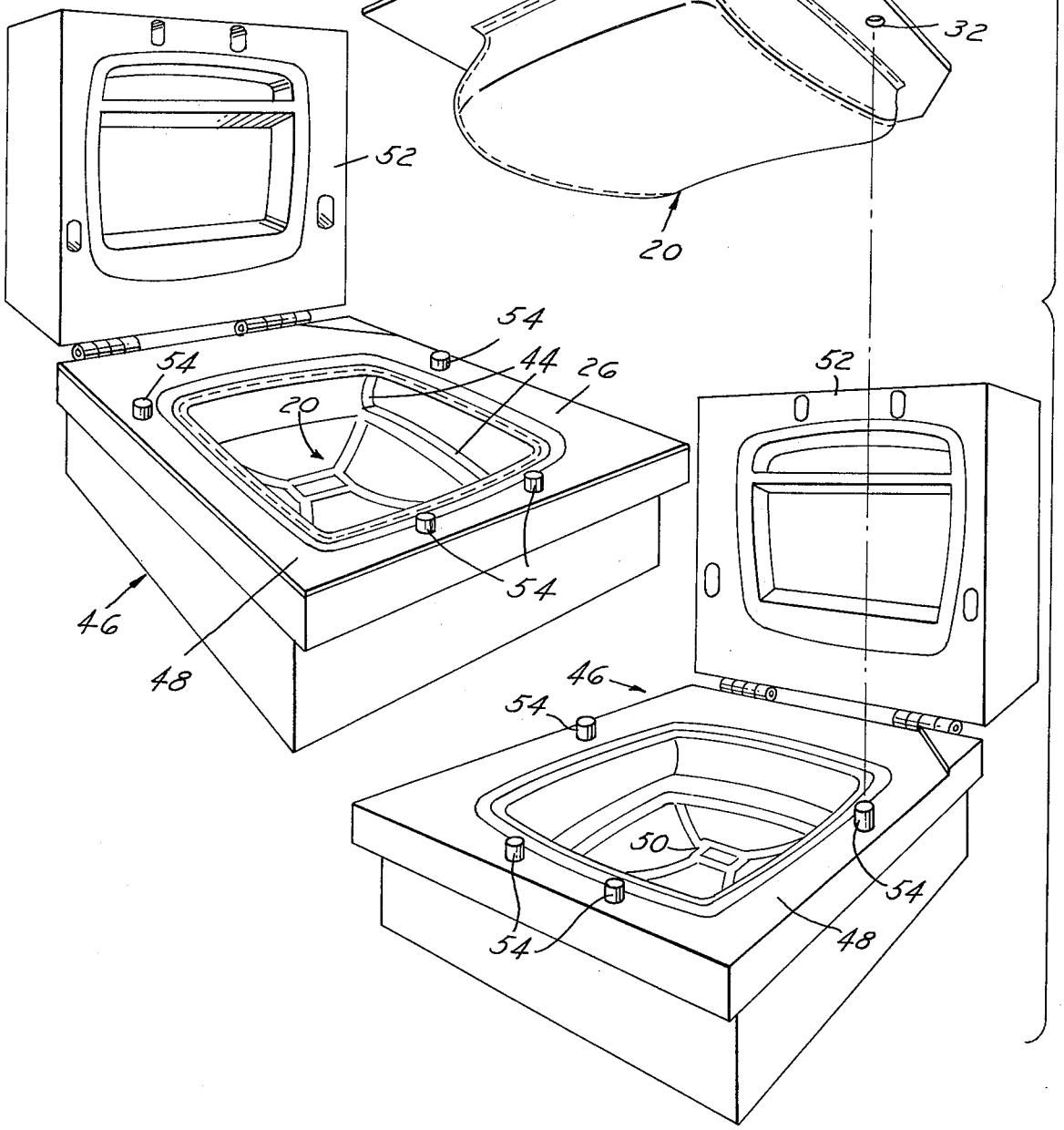
FIG. 6 represents the cover located in the foaming mold prior to a foaming operation.

An operator inserts the locating member 26 and the attached cover 20 into the foaming mold 46 so that the cover 20 is placed in the mold portion 48 which has the die surface 50. A vacuum is applied to the die surface 50 and the cover is drawn into contact therewith and held thereby. This condition is illustrated in FIG. 6. As seen in this figure, the pieces of tape 44 are facing upwardly on the interior volume of the cover 20 to provide the barrier so that no foam can leak through the openings formed along the sew lines.

A foaming composition such as a high resilient cold cure urethane foam sold by Inmont under the name Polyurethane Foam is placed inside the mold. The cover portion 52 of the mold is closed and the foam is allowed to react. When the foam reacts, it fills the entire internal volume defined in the cover member with a resilient foam.

After the foaming operation is over, the cover portion 52 of the foaming mold 46 is opened and the combined locating member 26, the cover 20 and the foam material produced therewithin by reaction of the foaming composition are removed from the mold. The locating member 26 is then cut off the peripheral edge of the cover member to produce a final cover member which may be used as an automobile seat cushion.

There has been disclosed herein a method of producing a covered article and, in particular, a method for producing a covered article which may be used as a seat for an automobile. In view of the teachings of this specification, those skilled in the art will be capable of making modifications of the method of this invention without departing from the true spirit and scope thereof. It is intended that all such modification which fall within the true spirit and scope of this invention be included within the scope of the appended claims.

We claim:

1. A method of making a covered article which comprises the steps of:

forming at least a pair of covering members of a covering material, said covering material being impervious to a foam material which is formed from a foamable composition;

sewing said covering members together along at least one sew line to form a cover having a peripheral edge portion therearound and an interior volume, said sewing operation placing openings through said cover which permit the passage of said foam material through said cover;

forming a locating member having both an inner peripheral edge portion therearound defining a central opening and locating portions between said inner peripheral edge portion and an outer peripheral edge portion, said locating member's inner peripheral edge portion having the same general configuration as said peripheral edge portion of said cover;

joining said peripheral edge portion of said cover to said inner peripheral edge portion of said locating member;

sealing said opening along said sew lines joining said covering members together so that said foam material produced upon foaming of said foamable composition cannot flow through said openings;

locating said cover and joined locating member in a foaming mold having a mold portion containing a die surface upon which a vacuum can be drawn and an openable cover portion, said locating portions of said locating member being aligned with locating positions on said foaming mold to align accurately said cover with said die surface of said foaming mold;

drawing a vacuum on said die surface of said foaming mold thereby to draw a facing surface of said cover into contact with said die surface;

placing a charge of said foamable composition into said interior volume of said cover defined between an inner surface of said cover and its peripheral edge when said cover is held in contact with said die surface by vacuum;

closing said cover portion of said foaming mold;

reacting said foamable composition to fill said interior volume of said cover with said foam material;

opening said foaming mold;

removing said cover, foam material and locating member from said foaming mold;

removing said locating member from said cover having said foam material therein thereby to form a covered article.

2. A method of making a covered article which comprises the steps of;

forming at least a pair of covering members of a covering material, said covering material being impervious to a foam material which is formed from a foamable composition;

sewing said covering members together along at least one sew line to form a cover having a peripheral edge portion therearound and an interior volume, said sewing operation placing openings through said cover which permit the passage of said foam material through said cover;

forming a locating member having both an inner peripheral edge portion therearound defining a central opening and locating openings between said inner peripheral edge portion and an outer peripheral edge portion, said locating member's inner peripheral edge portion having the same general configuration as said peripheral edge portion of said cover;

sewing said peripheral edge portion of said cover to said inner peripheral edge portion of said locating member;

sealing said opening along said sew lines joining saiid covering members together so that said foam material produced upon foaming of said foamable composition cannot flow through said openings;

locating said cover and joined locating member in a foaming mold having a mold portion containing a die surface upon which a vacuum can be drawn and an openable cover portion, said locating opening of said locating member being aligned with locating pins provided on said foaming mold to align accurately said cover with said die surface of said foaming mold;

drawing a vacuum on said die surface of said foaming mold thereby to draw a facing surface of said cover into contact with said die surface;

placing a charge of said foamable composition into said interior volume of said cover defined between an inner surface of said cover and its peripheral edge when said cover is held in contact with said die surface by vacuum;

closing said cover portion of said foaming mold;

reacting said foamable composition to fill said interior volume of said cover with said foam material;

opening said foaming mold;

removing said cover, foam material and locating member from said foaming mold;

removing said locating member from said cover having said foam material therein thereby to form a covered article.

3. A method of forming a covered seating member which comprises the steps of:

forming the necessary seating parts of a covering material which is impervious to a foam material which is formed from a foamable composition; said covering material having a first surface to form the exposed portion of the finished member and a second surface to form the interior surface of the finished member;

sewing said seating parts together along sew lines to form a seating member having a peripheral edge portion and inner and outer surfaces, said sewing operation placing openings through said seating member which permit the passage of said foam material through said seating member;

forming a locating member having both an inner peripheral edge portion therearound defining a central opening and locating portions between said inner peripheral edge portion and an outer peripheral edge portion, said locating member's inner peripheral edge portion having the same general configuration as said peripheral edge portion of said seating member;

sewing said peripheral edge portion of said seating member to said inner peripheral edge portion of said locating member;

placing said seating member on a seating buck with said inner surface of said seating member exposed thereby exposing the inner surfaces of said sew lines;

sealing said openings along said sew lines joining said seating parts together so that foam material produced upon foaming of said foamable composition cannot flow through said openings;

reversing said seating member so that said outer surface thereof is exposed;

locating said seating member and attached locating member in a foaming mold having both a mold portion containing a die surface upon which a vacuum can be drawn and an openable cover portion, said locating portions of said locating member being aligned with locating portions on said foaming mold to align accurately said seating member with said die surface of said foaming mold;

drawing a vacuum on said die surface of said foaming mold thereby to draw said outer surface of said seating member into contact with said die surface;

placing a charge of said foamable composition into an interior volume of said seating member defined between its inner surface and its peripheral edge portion when said seating member is held in contact with said die surface by vacuum;

closing said cover portion of said foaming mold;

reacting said foamable composition to fill said interior volume of said seat member with said foam material;

opening said foam mold;

removing said seat member, foam material and locating member from said foaming mold;

removing said locating member from said seat member having said foam material therein thereby to form a covered seating member.

4. The method of forming a covered seating member as set forth in claim 3 wherein: said locating portions of said locating member are openings therethrough and said locating portions on said foaming member are pins which are received in said openings.

5. The method of forming a covered seating member as defined in claim 3 wherein: a vacuum is drawn on said seating buck after said seating member has been placed thereupon whereby the seating member is accurately aligned with said seating buck and held in a fixed position relative thereto.

6. The method of forming a covered seating member as defined in claim 5 wherein: said sealings of said opening along said sew lines is accomplished on said seating buck by bonding strips of a foam impervious material along said sew lines.

7. The method of forming a covered seating member as defined in claim 6 wherein: said strips of foam impervious material have a self-bonding adhesive therealong for bonding it to said sew lines.

8. The method of forming a covered seating member as defined in claim 3 wherein: said seating member is reversed as it is pulled off of said seating buck.

9. The method of forming a covered seating member as defined in claim 3 wherein: said seating member and locating member are provided with sewing alignment devices thereon, and wherein said sewing alignment devices of said seating member and locating member are aligned with respect to one another prior to sewing said peripheral edge portion of said seating member to said inner peripheral edge portion of said locating member.

* * * * *